US008499957B2

(12) United States Patent
Kawachi

(10) Patent No.: US 8,499,957 B2
(45) Date of Patent: Aug. 6, 2013

(54) RUBBER PLUG FOR A MEDICAL VIAL CONTAINER

(75) Inventor: Yasushi Kawachi, Sumida-ku (JP)

(73) Assignee: Daikyo Seiko Ltd., Tokyo (JP)

( * ) Notice: Subject to any disclaimer, the term of this patent is extended or adjusted under 35 U.S.C. 154(b) by 0 days.

(21) Appl. No.: 13/137,807

(22) Filed: Sep. 14, 2011

(65) Prior Publication Data

US 2012/0067888 A1 Mar. 22, 2012

(30) Foreign Application Priority Data

Sep. 17, 2010 (JP) ..... 2010-209157

(51) Int. Cl.
*B65D 53/00* (2006.01)

(52) U.S. Cl.
USPC ..... 220/233; 220/789; 215/355

(58) Field of Classification Search
USPC ..... 220/787, 789, 800, 801, 307, 233, 220/DIG. 19; 215/296, 355
See application file for complete search history.

(56) References Cited

U.S. PATENT DOCUMENTS

| | | | | |
|---|---|---|---|---|
| 4,441,621 | A * | 4/1984 | Matukura et al. | 215/247 |
| 5,114,794 | A * | 5/1992 | Sudo et al. | 428/447 |
| 5,845,797 | A * | 12/1998 | Sudo et al. | 215/247 |
| 5,994,465 | A * | 11/1999 | Sudo et al. | 525/105 |
| 2007/0224491 | A1 * | 9/2007 | Woo | 429/72 |
| 2009/0132048 | A1 | 5/2009 | Denzer | |
| 2011/0266184 | A1 * | 11/2011 | Suzuki et al. | 206/524.1 |

FOREIGN PATENT DOCUMENTS

| | | | |
|---|---|---|---|
| DE | 94 15 072 | U1 | 11/1994 |
| EP | 0 172 613 | A2 | 2/1986 |
| JP | S55-47850 | U | 3/1980 |
| JP | H0698921 | A | 4/1994 |
| JP | 2002-209975 | A | 7/2002 |
| WO | WO 99/08065 | A1 | 2/1999 |

* cited by examiner

*Primary Examiner* — Anthony Stashick
*Assistant Examiner* — Kareen Rush
(74) *Attorney, Agent, or Firm* — Manabu Kanesaka

(57) ABSTRACT

A rubber plug for a vial container containing medicinal chemicals according to the present invention can be smoothly conveyed by a part feeder while preventing each other's adhesion.

The top surface of a discoid cap portion 1A has a Shore A hardness of 25-55 and a surface roughness Ra of 2.5-10.5 μm. Adherence of the top surface of the discoid cap portion 1A is reduced by synergy effect. The rubber plug 1 can be smoothly conveyed by a part feeder in an inverted position which turns the top surface of the discoid cap portion to the conveying surface.

11 Claims, 7 Drawing Sheets

RUBBER PLUG FOR A MEDICAL VIAL CONTAINER

RELATED APPLICATIONS

The present application is based on, and claims priority from, Japanese Application No. JP2010-209157 filed Sep. 17, 2010, the disclosure of which is hereby incorporated by reference herein in its entirety.

TECHNICAL FIELD

The present invention relates to a rubber plug for a medical container for sealing an opening of a vial container which contains medicinal chemicals.

BACKGROUND ART

A plug for sealing an opening of a vial container is required to have a number of quality performances e.g., sealing performance, gas barrier performance, chemical resistance and needlestick resistance. Rubber plugs having excellent elastic deformation capabilities have been widely used as plugs which satisfy these required performances.

In general, a rubber plug is formed so as to have a thick discoid cap portion and a thick cylindrical leg portion. The cylindrical leg portion has a diameter which is smaller than that of the cap portion and protrudes from the bottom surface of the cap portion. The lower surface of the flange of the discoid cap portion can be in close contact with the end surface of the opening of the vial container by driving the cylindrical leg portion into the inner periphery of the opening of the vial container.

Among these types of rubber plugs for vial containers, a rubber plug for sealing an opening of a vial container which contains medicinal chemicals needs to have quality properties which comply with a test method for an infusion rubber plug which is described in the $15^{th}$ revised Japanese Pharmacopoeia. In particular, such a rubber plug needs to pass an eluted substance test for one hour at 121° C. using a high pressure steam sterilizer which requires a high heat resistance.

As a material for a rubber plug for a vial container which meets the requirement, synthetic rubber like butyl rubber or isoprene rubber, styrene thermoplastic elastomer like SEBS and thermoplastic elastomer which comprises polyisobutylene or polybutadiene in major proportions have been conventionally utilized.

In general, the surface of rubber materials is adhesive. The rubber plugs made of this kind of rubber materials may happen to adhere each other and may cause troubles when a number of rubber plugs are handled together in a single production line.

It is proposed to form projecting portions in a texture pattern on at least part of the surface of a rubber plug for a vial container in order to prevent rubber plugs for vial containers from adhering each other. See Patent Document 1, for example. It is also proposed to deposit fluoro-rubber vulcanization coating on part of the surface or entire surface of a rubber plug for a vial container. See Patent Document 2, for example. It is further proposed to coat the surface of a rubber plug for a vial container with a thermo-plastics film. See Patent Document 3, for example.

Patent Document 1: Japanese Laid-open Patent Application No. Hei 10-94581

Patent Document 2: Japanese Laid-open Utility Model Application No. Sho 55-47850

Patent Document 3: Japanese Laid-open Patent Application No. 2002-209975

DISCLOSURE OF INVENTION

Problems to be Resolved by the Invention

A rubber plugs for a vial container described above i.e., a rubber plugs for a vial container which is made of a rubber material and has a cylindrical leg portion protruding from the bottom surface of a discoid cap portion may be conveyed by a part feeder in a production line or a capping line for driving a rubber plug into a vial container after medicinal chemicals are filled in it.

A rubber plug for a vial container is usually conveyed in an inverted position which turns the top surface of the discoid cap portion to the conveying surface of a part feeder. However a rubber plug for a vial container sometimes falls down and may not be smoothly conveyed due to an adhesive force between the top surface of the discoid cap portion and the conveying surface of the part feeder.

This invention is made in order to resolve the above described problems. An object of the present invention is to provide a rubber plug for a vial container for containing medicinal chemicals which can realize a smooth convey using a part feeder and certainly prevent each other's adhesion.

Means for Solving the Problems

In order to resolve the problems, a rubber plug according to the present invention is a rubber plug for sealing the opening of the vial container which contains medicinal chemicals being made of thermoplastic elastomer and comprising a discoid cap portion and a cylindrical leg portion, the cylindrical leg portion has a diameter smaller than that of the discoid cap portion and protrudes from the bottom surface of the discoid cap portion, the surface of the cylindrical leg portion is coated with a synthetic resin film, the top surface of the discoid cap portion has a Shore A hardness in a range from 25 to 55 and a surface roughness Ra in a range from 2.5 μm to 10.5 μm.

According to a rubber plug for a medical vial container, the adherence of the top surface of the discoid cap portion is reduced by synergy effect of a Shore A hardness of the top surface of the discoid cap portion in a range from 25 to 55 and a surface roughness Ra of the top surface in a range from 2.5 μm to 10.5 μm. A rubber plug for a medical vial container according to the present invention can be smoothly conveyed by a part feeder at an inverted position which turns the top surface of the discoid cap portion to the conveying surface.

A rubber plug for a medical vial container according to the present invention does not cause each other's adhesion even when a number of rubber plugs are packaged together in a bag because the adherence of the top surface of the discoid cap portion is reduced and the surface of the cylindrical leg portion is coated by a synthetic resin film.

A rubber plug for a medical vial container according to the present invention can be easily molded by forming the top surface of the discoid cap portion by thermoplastic elastomer.

In a rubber plug for a medical vial container according to the present invention, a supporting protrusion can be formed on the top surface of the discoid cap portion for supporting the rubber plug in an inverted position. It is preferable to set the surface roughness Ra of at least the supporting protrusion on the top surface of the discoid cap portion to a range from 2.5 μm to 10.5 μm.

Effect of the Invention

In a rubber plug for a medical vial container according to the present invention, the adherence on the top surface of the discoid cap portion is reduced by synergy effect of a Shore A hardness of the top surface of the discoid cap portion in a range from 25 to 55 and a surface roughness Ra of the top surface in a range from 2.5 μm to 10.5 μm. Therefore a rubber plug can be smoothly conveyed by a part feeder in an inverted position which turns the top surface of the discoid cap portion to the conveying surface.

A rubber plug for a medical vial container according to the present invention can certainly prevent each other's adhesion even when a number of rubber plugs are packaged together in a bag because the adherence of the top surface of the discoid cap portion is reduced and the surface of the cylindrical leg portion is coated with a synthetic resin film.

A MODE FOR IMPLEMENTING THE INVENTION

Figure 1:
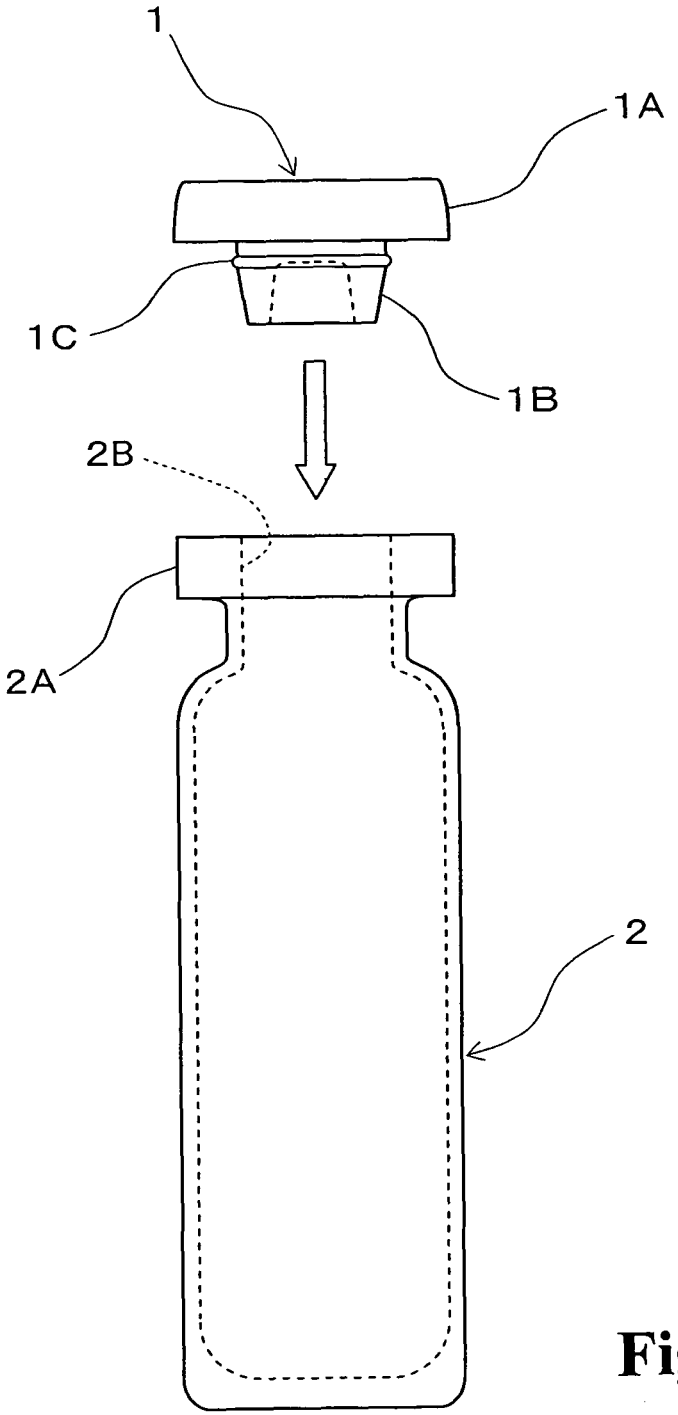
FIG. 1 shows a front view of a rubber plug for a medical vial container according to the present invention and an exemplary medical vial container.
Figure 2:
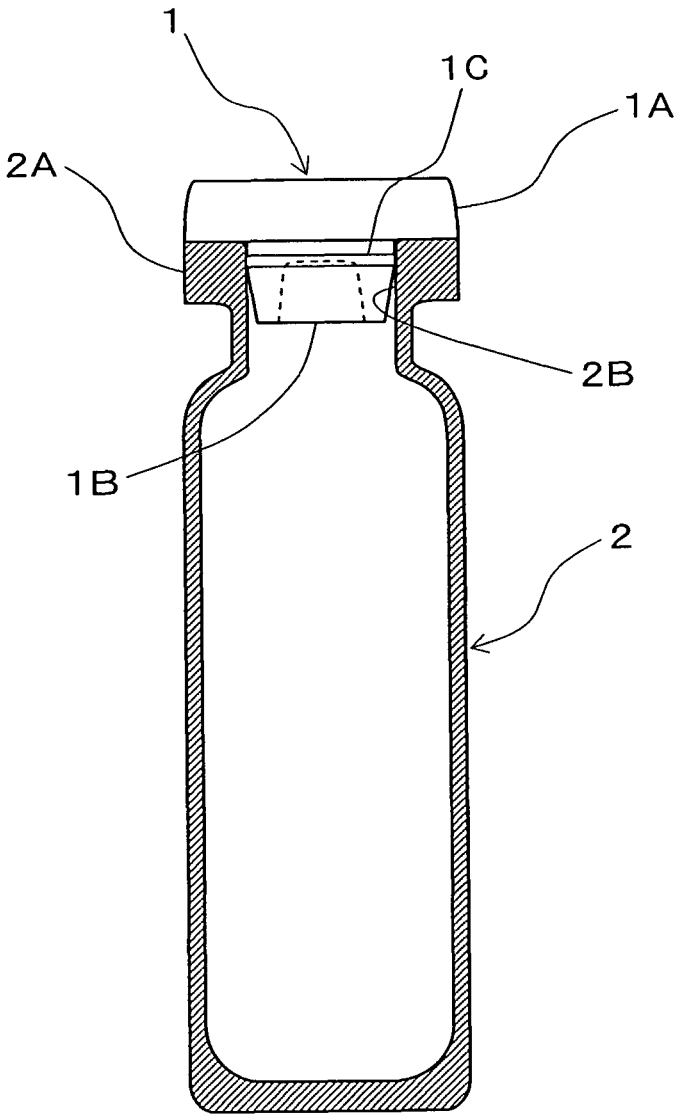
FIG. 2 shows a longitudinal sectional view of a rubber plug for a medical vial container which was driven into an opening of an exemplary medical vial container.

One embodiment of a rubber plug for a medical vial container according to the present invention will be explained below referring to drawings. As shown in FIGS. 1 and 2, a rubber plug 1 for a medical vial container according to one embodiment (will be referred to a rubber plug for a vial container below) is for sealing an opening of a medical vial container 2 (will be referred to a vial container bellow) which contains e.g., liquid medicinal chemicals. By using a capper (not shown), the rubber plug is driven into a ring lip portion 2A as a flange which is formed on the opening of the vial container 2.

The rubber plug 1 for a vial container is formed so that a thick cylindrical leg portion 1B concentrically protrudes from the bottom surface of a thick discoid cap portion 1A. The diameter of the cylindrical leg portion 1B is smaller than that of the discoid cap portion 1A. A sealing portion 1C is integrally formed on the outer peripheral surface of the base portion of the cylindrical leg portion 1B. The outer peripheral surface of the cylindrical leg portion 1B constitutes a tapered surface between the sealing portion 1C and the tip.

According to the rubber plug 1 for a vial container having the above described shape, the opening of the vial container 2 is sealed by driving the cylindrical leg portion 1B into the vial container 2 to mate the inner peripheral surface 2B of the ring lip portion 2A of the vial container 2 with the cylindrical leg portion 1B, adhere the sealing portion 1C tightly to the inner peripheral surface 2B of the ring lip portion 2A and adhere the bottom surface of the flange portion of the discoid cap portion 1A tightly to the upper surface of the ring lip portion 2A (see FIG. 2).

The size of the rubber plug 1 for a vial container is determined depending upon a diameter of the opening of the vial container 2. The diameter of the discoid cap portion 1A is usually in a range from 5 mm to 50 mm.

Figure 3:
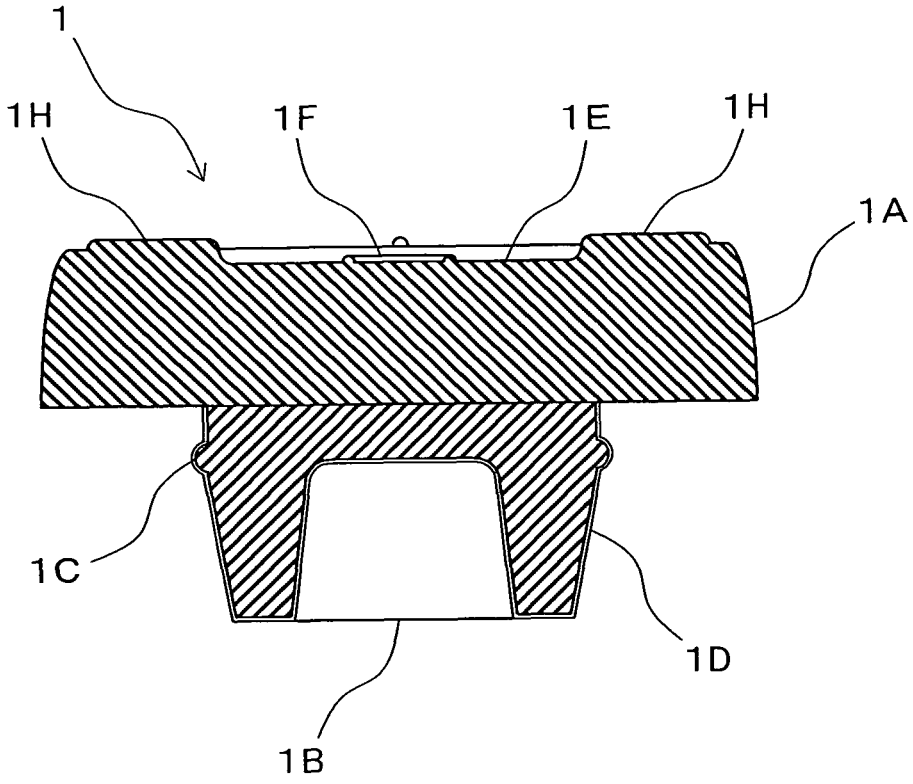
FIG. 3 shows an enlarged longitudinal sectional view of the rubber plug for a medical vial container shown in FIG. 1.

As shown in FIG. 3, the surface of the discoid cap portion 1A of the rubber plug 1 for a vial container remains in rubber basis material. On the other hand, the surface of the cylindrical leg portion 1B is coated with a synthetic resin film 1D. The surface of the cylindrical leg portion 1B is pressure shaped and punched integral with the synthetic resin film 1D. The discoid cap portion 1A is pressure shaped integral with the cylindrical leg portion 1B by accommodating the cylindrical leg portion 1B in a mold.

Well known rubber materials and thermo-plastic elastomers can be used as the material for the discoid cap portion 1A and the cylindrical leg portion 1B of the rubber plug 1 for a vial container.

Specifically, synthetic rubber like regular butyl rubber, butyl halide rubber, isoprene rubber, butadiene rubber, styrene-butadiene rubber, nitrile rubber, etc., natural rubber, ethylene-propylene rubber (EPDM) or rubber material comprising polybutadiene or polyisobutylene in major proportions can be used as rubber material in view of a high heat resistance in addition to a sealing performance, a gas barrier performance, a chemical resistance and a needlestick resistance.

Styrene-ethylene-butylene-styrene (SEBS) thermoplastic elastomer or thermoplastic elastomer comprising polyisobutylene or polybutadiene in major proportions can be used as thermoplastic elastomer. Among these materials, it is preferable to use thermoplastic elastomer comprising polyisobutylene or polybutadiene in major proportions because they have a high gas imperviableness, a high ozone resistance and a high anti-aging performance in addition to the hardenability.

The a synthetic resin film 1D which coats the surface of the cylindrical leg portion 1B has a thickness in a range from 0.001 mm to 0.3 mm, preferably in a range from 0.01 mm to 0.2 mm, more preferably in a range from 0.02 mm to 0.15 mm. The thickness is set in such a range because a film with a low porosity can be obtained and a low level of defectiveness is achieved. It is difficult to produce a too thin film, such a too thin film can be easily broken in a shaping process and the product quality cannot be sufficiently guaranteed. It is also difficult to obtain an appropriate sealing performance and a needlestick resistance with a too thick film when it is processed to a rubber plug because the stiffness property of the film becomes too high.

For the synthetic resin film 1D, it is appropriate to use an inactive film having a high heat resistance and a high chemical resistance and having a lower friction resistance in comparison with rubber material. For example, a fluorinated resin film or an ultrahigh molecular weight polyethylene resin film having a molecular weight in a range from 1,000,000 to 7,000,000 can be used.

For a fluorinated resin film which is preferable as the synthetic resin film 1D, tetrafluoroethylene resin (PTFE), tetrafluoroethylene-perofluoroethylene copolymer (PFA), tetrafluoroethylene-hexafluoropropylene copolymer (FEP), tetrafluoroethylene-ethylene copolymer (ETFE), trichlorotrifluoroethylene (PCTFE), or polyvinylidene fluoride (PVDF) or polyvinyl fluoride (PVF) can be used.

Among these resins, it is especially preferable to use tetrafluoroethylene resin (will be referred to PTFE bellow) because it has properties which satisfy physical properties and chemical properties which are desired as surface coating film material for a sealing plug for sealing a vial container, specifically it has a high stability to dissolution and swelling in almost all kind of chemicals, it falls into the category of a highest heat resistance among organic materials, it has a melting point of about 327° C., it becomes only a transparent gelled material but it does not flow when it is melting, it has a very high continuous operating temperature of about 260° C., and its surface has a high hydrophobic property, a high lipophobic property, a high nonviscous property and a high sliding property with a low friction coefficient. Because of these advantages, it can endure a high temperature sterilization procedure in a drug formulation process, it does not absorb medical agents in coating material even when it contacts with medical agents contained in a vial container for long time, it has a high chemical stability which prevents the coating material from elution, and it has a high sliding property for press fitting the rubber plug smoothly into the vial container after filling medicinal agents.

Figure 4:
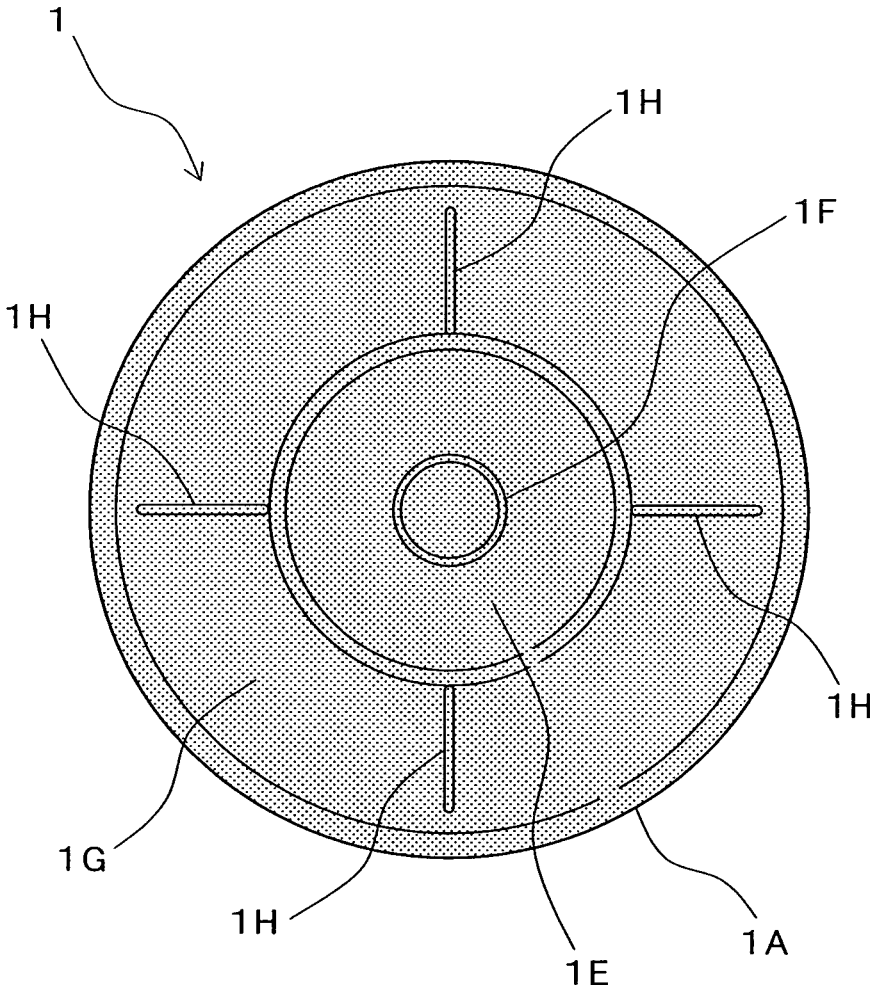
FIG. 4 shows an enlarged plan view of the rubber plug for a medical vial container shown in FIG. 1.

As shown in FIG. 3 and FIG. 4, a shallow circular recess 1E is formed in the central region on the top surface of the discoid cap portion 1A of the rubber plug 1 for a vial container. A target mark 1F of a ring shape having a low height is formed as a target for needlestick in the central portion of the circular recess 1E so that the target mark 1F does not protrude from the top surface of the discoid cap portion 1A. Four supporting protrusions 1H are disposed crosswise on a ring-like planer section 1G which surrounds the circular recess 1E so that the four supporting protrusions 1H protrude from the top surface of the discoid cap portion 1A and extend in a radial fashion.

The supporting protrusions 1H are formed in order to support the rubber plug 1 for a vial container in an inverted position which turns the top surface of the discoid cap portion 1A upside down. The protruding height of the supporting protrusions 1H is in a range from 0.5 mm to 3 mm, and the width of the supporting protrusions 1H is in a range from 0.5 mm to 5 mm.

The Shore A hardness of the entire top surface of the discoid cap portion 1A is set to a range from 25 to A55. The Shore A hardness is preferably set to a range from 25 to 50 and more preferably a range from 30 to 45.

When the Shore A hardness is set to 55 or less and the surface roughness Ra is set to a range from 2.5 μm to 10.5 μm (will be discussed bellow), it is possible to not only achieve smooth convey of rubber plugs by a part feeder and a desirable adherence which prevents rubber plugs from each other's adhesion when many rubber plugs are stocked but also effectively prevent a gouged rubber portion from dropping into a vial container (so called coring phenomenon) when a needle is inserted into a too hard rubber plug in use where an injection needle or other needle is inserted into the rubber plug.

The Shore A hardness can be adjusted by adding synthetic resin powder e.g., ultrahigh molecular weight polyethylene powder or inorganic powder e.g., clay to rubber plug composition as compounding agent or reducing or eliminating compounding agent e.g., plasticizing agent or oil Although the hardness of the top surface of the discoid cap portion 1A is set as described above in order to improve the slipperiness of the top surface according to the present invention, the hardness of the leg portion is also adjustable within the scope of the present invention.

The entire surface of the top surface of the discoid cap portion 1A including the supporting protrusions 1H is formed so that the surface roughness Ra as a centerline average roughness is in a range from 2.5 μm to 10.5 μm. The molding surface of the mold for press molding the top surface of the discoid cap portion 1A is roughened up by shot blast finishing or etching, and the surface roughness of the mold surface is transcribed to the top surface of the discoid cap portion 1A. The surface roughness Ra is set to preferably a range from 2.72 μm to 9.35 μm, and more preferably a range from 4.00 μm to 7.00 μm.

Thermoplastic elastomer is preferably used as a constituent of the top surface of the discoid cap portion 1A. It is preferable to use thermoplastic elastomer as a constituent of the top surface in view of no possibility of elution of cross-linking agent and a high formability. As thermoplastic elastomer which has a property intermediate between rubber and plastics, it is preferable to use e.g., olefinic elastomer (TPO), styrene elastomer (SBC), vinyl chloride elastomer (TPVC), urethane elastomer (TPU), polyester elastomer (TPEE), polyamide elastomer (TPAE), fluorinated elastomer (TPF), polybutadiene elastomer (RB), polyisobutylene elastomer, silicone elastomer, ethylene-vinyl acetate (EVA, EEA).

Among these elastomers, in view of a heat resistance and an elution property it is preferable to use e.g., styrene-ethylene-butadiene copolymer (SEBS), styrene-butadiene copolymer (SBS), styrene-isoprene copolymer (SIS), styrene-isobutylene copolymer (SIBS).

In the rubber plug 1 for a vial container according to one embodiment of the present invention which is constituted as above, since the Shore A hardness of the top surface of the discoid cap portion 1A is set to a range from 25 to 55 and the surface roughness Ra is set to a range from 2.5 μm to 10.5 μm the adherence of the top surface of the discoid cap portion 1A is reduced by synergy effect.

In the rubber plug 1 for a vial container according to this embodiment, it is possible to smoothly convey without jamming a number of the rubber plugs 1 in an inverted position by turning the top surface of the discoid cap portion 1A to the conveying surface of a part feeder (not shown). Even if the top surface of plural rubber plugs contact, they do not adhere each other.

In the rubber plug 1 for a vial container according to one embodiment, even when a number of rubber plugs are packaged together in a bag and stocked, it does not cause each other's adhesion because the adherence of the top surface of the discoid cap portion 1A is reduced and the surface of the cylindrical leg portion 1B is coated with a synthetic resin film 1D.

In the rubber plug 1 for a vial container according to one embodiment, a number of rubber plugs 1 can be smoothly conveyed by a part feeder in an inverted position which turns the top surface of the discoid cap portion 1A to a conveying surface. Furthermore it is possible to certainly prevent a number of rubber plugs 1 for vial containers which are handled together from adhering each other.

A rubber plug for a vial container according to the present invention should not be limited to the above described embodiment. For example, the shape of the circular recess 1E on the top surface of the discoid cap portion 1A and the supporting protrusions 1H shown in FIG. 4 can be modified to the shape shown in FIGS. 5-7.

Figure 5:
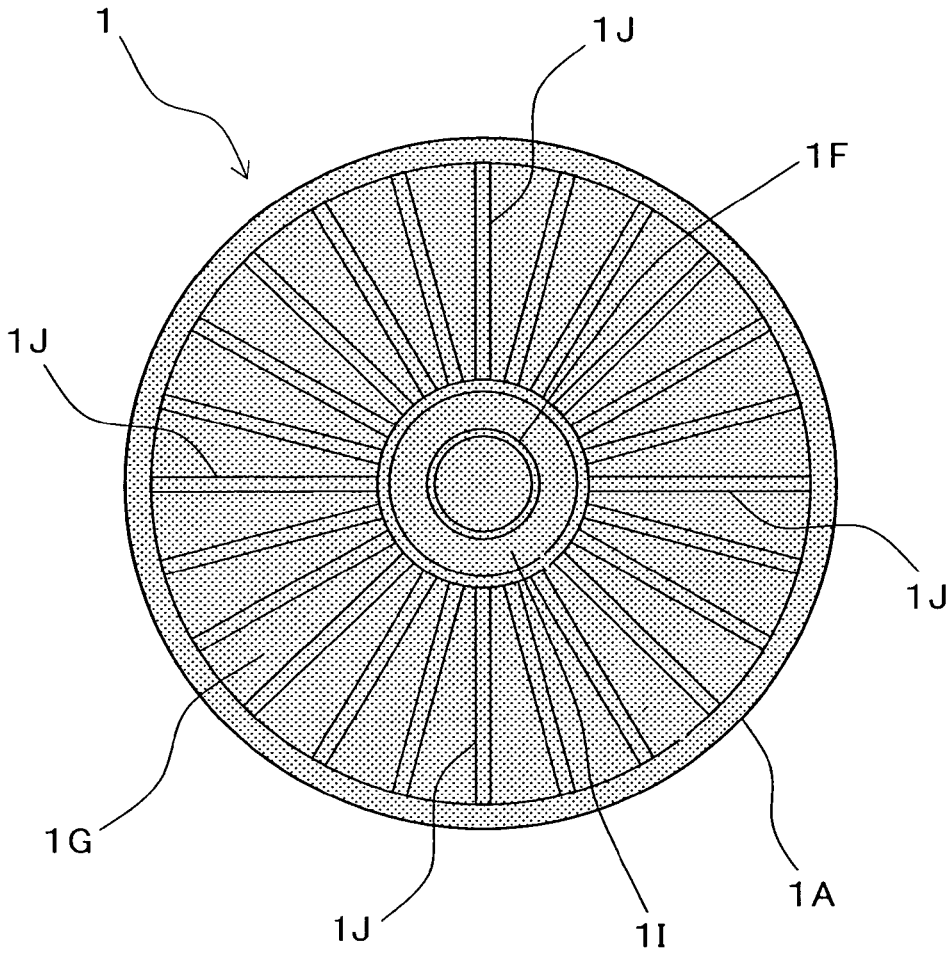
FIG. 5 shows an enlarged plan view of a first modified example for a supporting protrusion shown in FIG. 4.

On the top surface of the discoid cap portion 1A shown in FIG. 5, a circular recess 1I has a diameter which is smaller than that of the circular recess 1E shown in FIG. 4. A plurality of supporting protrusions 1J are disposed in a surrounding area of the circular recess 11 so that the supporting protrusions 1J extend in a radial ribbed fashion. The effect of this modified example is similar to that of the above described embodiment.

Figure 6:
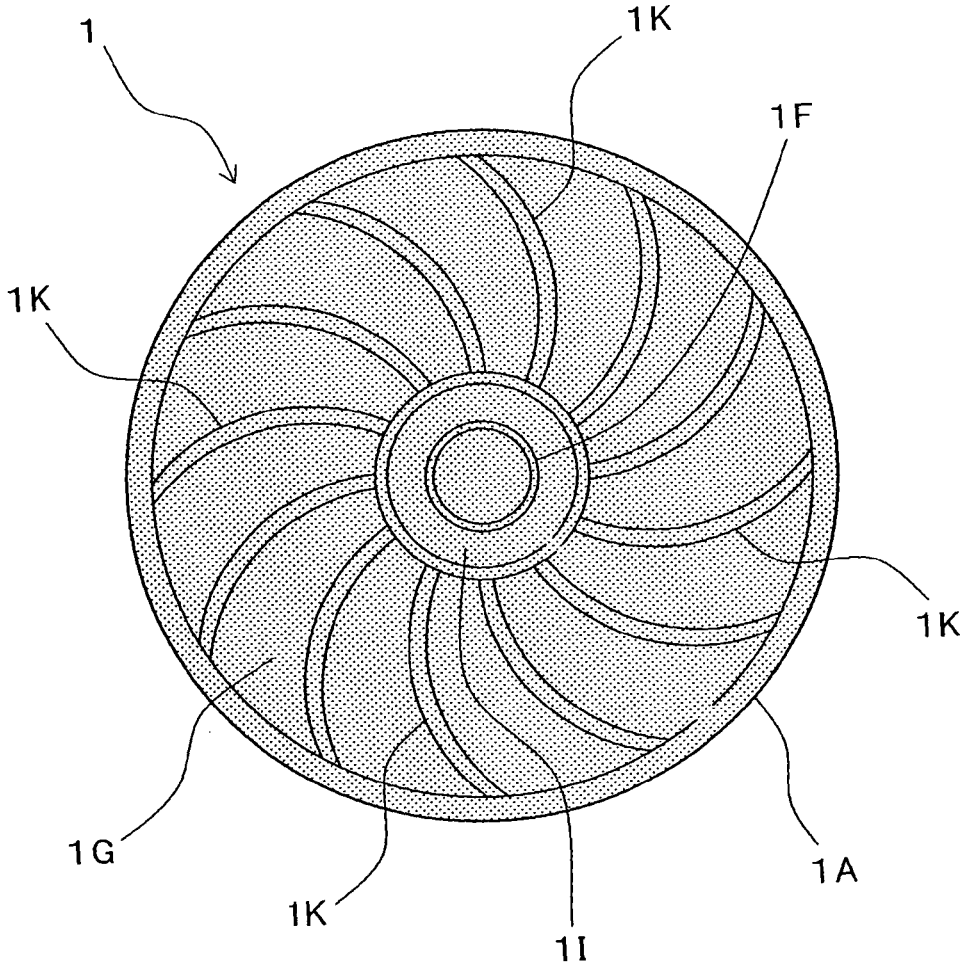
FIG. 6 shows an enlarged plan view of a second modified example for a supporting protrusion shown in FIG. 4.

On the top surface of the discoid cap portion 1A shown in FIG. 6, a plurality of curved supporting protrusions 1K extend in a radial direction in place of the supporting protrusions 1J which extend in a radial ribbed fashion shown in FIG. 5. The effect of this modified example is also similar to that of the above described embodiment.

Figure 7:
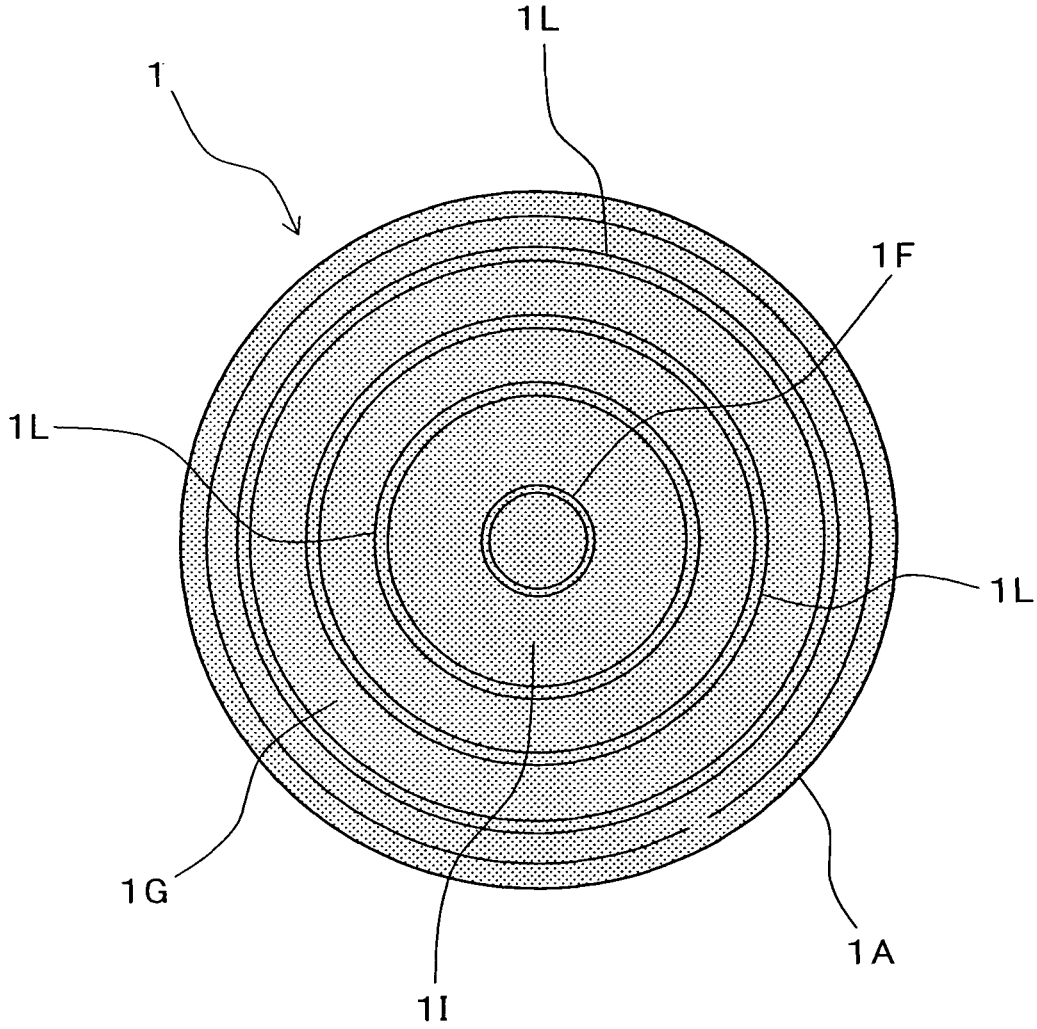
FIG. 7 shows an enlarged plan view of a third modified example for a supporting protrusion shown in FIG. 4.

On the top surface of the discoid cap portion 1A shown in FIG. 7, there is no circular recess 1E shown in FIG. 4 and a target mark 1F is formed in the center portion of the planer top surface of the discoid cap portion 1A. Triple supporting protrusions 1L are formed surrounding the target mark 1F in a concentric fashion. The three supporting protrusions 1L protrude higher than the target mark 1F. The effect of this modified example is also similar to that of the above described embodiment.

Although it is not shown in drawings, the supporting protrusions 1H may be a plurality of cylindrical members or a plurality of prismatic members which protrude to a certain low height and are formed at certain intervals. Alternatively the supporting protrusions 1H protruding to a certain low height may be formed in a reticular pattern.

Working Example

The present invention will be explained in more detail by referring to working examples and comparative examples. The present invention should not be limited to the working examples.

Ten kinds of molds for press molding the top surface of the discoid cap portion 1A of the rubber plugs 1 for a vial container were prepared. The inner surfaces of the molds for transcription were pearskin-finished by shot-blast finishing using projection members of particle size in a range from #20 to #100. One hundred rubber plugs for a vial container for each of the Working Examples 1 through 7 and the Comparative Examples 1 through 3 were molded using each of the ten kinds of molds respectively. SIBS series thermoplastic elastomer made by KANEKA Corporation was used as a material for the discoid cap portion 1A of rubber plugs for a vial container which were formed as Working Examples 1 through 7 and Comparative Examples 1 through 3. The same material was used for both the discoid cap portion and the cylindrical leg portion. PTFE film made by NITTO DENKO Corporation was used as a synthetic resin film which coats the surface of the thermoplastic elastomer.

The surface roughness Ra and the Shore A rubber hardness were measured with regard to the top surface of the discoid cap portion 1A of the rubber plugs for a vial container as the Working Examples 1 through 7 and the Comparative Examples 1 through 3. The measurement was performed using a laser microscope (KEYENCE Corporation, an ultradeep color 3D geometry measurement microscope VK-9500) on the condition that the lens magnification was 10 times, the measurement mode was color ultradeep, the pitch was 0.10 μm and the optical zoom was 1.0 times.

The measured surface roughness Ra and the Shore A rubber hardness for the Working Examples 1 through 7 and the Comparative Examples 1 through 3 are shown in Table 1.

The following evaluation test was also performed using one hundred rubber plugs for each of the Working Examples 1 through 7 and the Comparative Examples 1 through 3 as experimental samples.

<Adherence Test>

One hundred rubber plugs as experimental examples were put in a plastic bag of 30 cm square so as to get together at the bottom of the bag. The extra air in the bag was vacuumed and the opening of the bag was sealed by heat sealing. The sealed bag was kept stationary at a regulated temperature of 40° C. in a drying machine for a week. The sealed bag was cut and the rubber plugs were taken out on a planner surface. The counted number of adhered rubber plugs are shown in Table 1.

<Part Feeder Convey Test>

A mock convey route was formed by connecting a bowl feeder (SINFONIA TECHNOLOGY Co., Ltd. DMS-30C), a linear feeder (NTN Corporation K-S10C2) and a 5 meter spiral rail for conveying rubber plugs in line.

One hundred rubber plugs were put in the bowl feeder and a convey performance was tested whether rubber plugs are conveyed to the rail end. Both of the bowl feeder and the linear feeder were driven by power of a frequency of 100 Hz. The slope angle of the route was set to about 15 degree. If it was jammed on the way, the evaluation result was noted "X" in Table 1.

[Table 1]

Satisfactory results for adherence and convey performance was obtained for the Working Examples 1 through 7. On the other hand, substantial number of rubber plugs were adhered each other and jams occurred on the way of the convey test for the Comparative Examples 1 through 3.

| Explanation of the reference numbers | |
|---|---|
| 1 | rubber plug for vial container |
| 1A | discoid cap portion |
| 1B | cylindrical leg portion |
| 1C | sealing portion |
| 1D | synthetic resin film |
| 1E | circular recess |
| 1F | target mark |
| 1G | ring-like planner section |
| 1H | supporting protrusion |
| 2 | vial container |
| 2A | ring lip portion |
| 2B | inner peripheral surface |

TABLE 1

| | Working Example | | | | | | | Comparative Example | | |
|---|---|---|---|---|---|---|---|---|---|---|
| | 1 | 2 | 3 | 4 | 5 | 6 | 7 | 1 | 2 | 3 |
| Surface Roughness Ra (μm) | 8.76 | 9.35 | 4.54 | 6.45 | 2.72 | 3.95 | 6.67 | 1.13 | 11.24 | 4.83 |
| Hardness | 30 | 45 | 32 | 40 | 32 | 43 | 54 | 32 | 43 | 20 |
| Adherence Test | ○ | ○ | ○ | ○ | ○ | ○ | ○ | 32/100 | 8/100 | 24/100 |
| Transport Test | ○ | ○ | ○ | ○ | ○ | ○ | ○ | X | X | X |

The invention claimed is:

1. A rubber plug for sealing an opening of a vial container which contains medicinal chemicals, comprising:

a discoid cap portion; and a cylindrical leg portion having a diameter smaller than a diameter of the discoid cap portion and protruding from a bottom surface of the discoid cap portion, wherein a surface of the cylindrical leg portion is coated with a synthetic resin film, and a top surface of the discoid cap portion has a Shore A hardness in a range from 25 to 55 and a surface roughness Ra in a range from 2.5 μm to 10.5 μm.

2. A rubber plug according to claim 1, wherein the discoid cap portion comprises thermoplastic elastomer.

3. A rubber plug according to claim 1, wherein the cylindrical leg portion comprises thermoplastic elastomer.

4. A rubber plug according to claim 1, further comprising a supporting protrusion for supporting the rubber plug in an inverted position, formed on the cap portion at a side opposite to the leg portion, wherein a surface roughness Ra of the supporting protrusion is in a range from 2.5 μm to 10.5 μm.

5. A rubber plug according to claim 4, wherein the cylindrical leg portion has a sealing portion integrally formed on an outer peripheral surface of a base portion thereof.

6. A rubber plug according to claim 5, wherein the discoid cap portion has a circular recess in a center part on the top surface thereof.

7. A rubber plug according to claim 6, wherein the circular recess has a ring-shaped target mark therein protruding upwardly from a bottom surface of the circular recess, and a height of the target mark is lower than the top surface of the discoid cap portion with respect to an inserting direction of the rubber plug so that the target mark does not protrude from the top surface of the discoid cap portion.

8. A rubber plug according to claim 5, wherein the discoid cap portion has a circular recess in a center part on the top surface thereof, and the circular recess has the supporting protrusion extending from an edge of the circular recess along the top surface of the discoid cap portion.

9. A rubber plug according to claim 8, wherein the circular recess has a plurality of the supporting protrusions extending radially from the edge of the circular recess.

10. A rubber plug according to claim 6, wherein the circular recess has a ring-shaped target mark therein, and the discoid cap portion has a plurality of the supporting protrusions concentrically surrounding the target mark on the top surface of the discoid cap portion.

11. A rubber plug according to claim 8, wherein a height of the supporting protrusion is 0.5-3 mm, and a width of the supporting protrusion is 0.5-5 mm.

* * * * *